United States Patent [19]

Young

[11] Patent Number: 4,669,281

[45] Date of Patent: Jun. 2, 1987

[54] CABLE/COMPUTER PERIPHERAL LOCK

[75] Inventor: James E. Young, La Honda, Calif.

[73] Assignee: Hewlett-Packard Company, Palo Alto, Calif.

[21] Appl. No.: 658,971

[22] Filed: Oct. 9, 1984

[51] Int. Cl.[4] ..... E05B 65/00

[52] U.S. Cl. ..... 70/57; 70/163; 70/DIG. 57

[58] Field of Search ..... 70/18, 57, 58, 158, 70/163–164, 166–173, DIG. 57; 411/427, 103, 178, 403; 248/551, 552, 553; 211/4, 8

[56] References Cited

U.S. PATENT DOCUMENTS

| | | | |
|---|---|---|---|
| 2,377,397 | 6/1945 | Booth | 411/403 |
| 2,643,787 | 6/1953 | Rockma | 70/57 |
| 3,279,519 | 10/1966 | Neuschotz | 411/178 |
| 3,624,317 | 11/1971 | Buckingham | 70/DIG. 57 |
| 4,311,883 | 1/1982 | Kidney | 70/57 |
| 4,488,764 | 12/1984 | Pfenning | 70/57 |

FOREIGN PATENT DOCUMENTS

| | | | |
|---|---|---|---|
| 1013163 | 7/1977 | Canada | 70/167 |

*Primary Examiner*—Robert L. Wolfe
*Attorney, Agent, or Firm*—Douglas L. Weller

[57] ABSTRACT

An apparatus is presented which protects the cabling system on a computer. The apparatus allows only bona fide users to electro/mechanically connect or disconnect cables to a computer system. The apparatus essentialy comprises a first structure and a locking cover. The first structure is attached to a first cable terminal and prevents other terminals from being electro/mechanically connected to the first cable terminal. The locking cover then prevents the first structure from being removed from the first cable terminal. In the preferred embodiment the first structure is attached to the first cable terminal by one or more screws and the locking cover prevents access to the screw(s).

9 Claims, 4 Drawing Figures

CABLE/COMPUTER PERIPHERAL LOCK

BACKGROUND

There is continually a search for means to protect computers from intruders gaining access or interfering with the access of legitimate users. One vulnerable point in computer security is the cabling system.

SUMMARY OF THE INVENTION

In accordance with the preferred embodiment of the present invention an apparatus is presented which protects the cabling system on a computer. The apparatus allows only bona fide users to electro/mechanically connect or disconnect cables to a computer system. The apparatus essentially comprises a first structure and a locking cover. The first structure is attached to a first cable terminal and prevents other terminals from being electro/mechanically connected to the first cable terminal. The locking cover then prevents the first structure from being removed from the first cable terminal. In the preferred embodiment the first structure is attached to the first cable terminal by one or more screws and the locking cover prevents access to the screw(s).

DESCRIPTION OF THE PREFERRED EMBODIMENT

Figure 1:
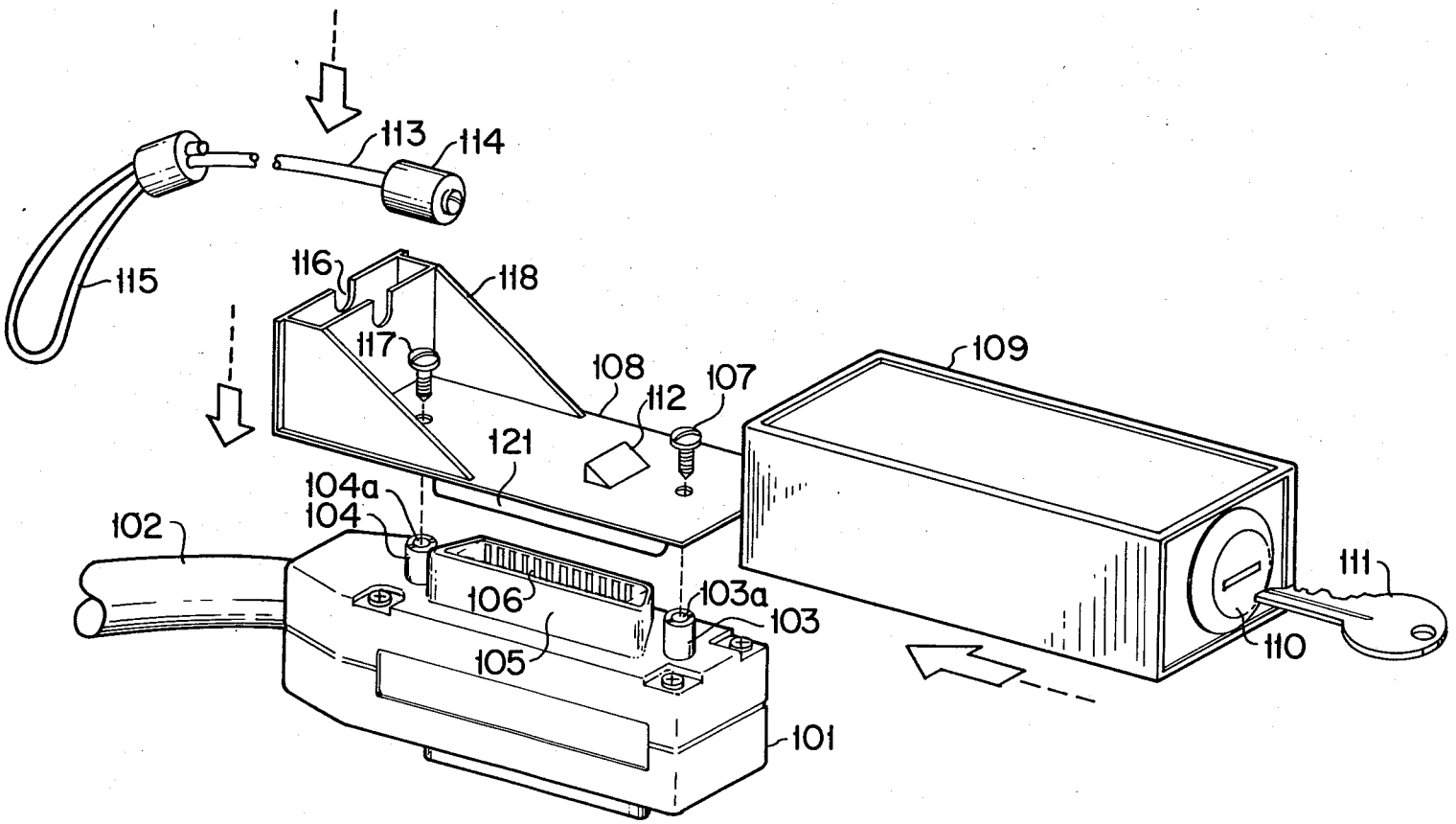
FIG. 1 shows a cable terminal, a first structure and a locking cover in accordance with the preferred embodiment of the present invention.

In FIG. 1 a cable 102 having a cable terminal 101 is shown. For instance, cable 102 and cable terminal 101 may conform to HPIL bus standards. Cable terminal 101 has a sleeve 105 protecting leads 106. A screw head 103 has a screw hole 103*a* and a screw head 104 has a screw hole 104*a*.

Figure 2:
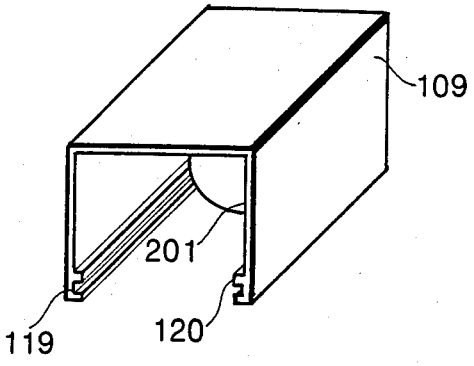
FIG. 2 shows another view of the locking cover of FIG. 1 in accordance with the preferred embodiment of the present invention.

A structure 118 may be attached to cable terminal 101 as shown. A sleeve 121 fits over sleeve 105. When sleeve 121 is in place, it prevents other terminals from being electrically coupled to leads 106. A screw 107 is screwed into screw hole 103*a* and a screw 117 is screwed into screw hole 104*a*. Once screws 107 and 117 are screwed into place, a cover 108 may be placed over structure 118 to prevent an intruder from gaining access to screws 107 and 117. A base section 108 of structure 118 is slid into a slot 119 and a slot 120 (shown in FIG. 2) of cover 119. Once in place a key 111 may be used to lock a lock 110 to secure cover 109 onto structure 118.

Figure 3:
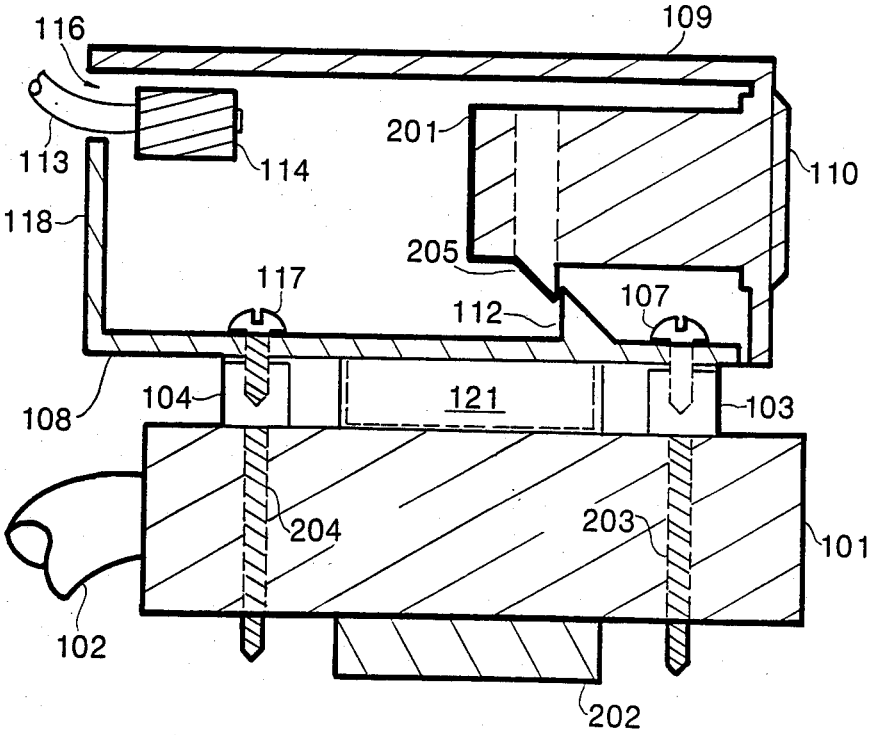
FIG. 3 is a cross sectional view of the cable terminal, the first structure and the locking cover in FIG. 1 shown in a "locked" position.

FIG. 3 shows a cross-sectional view of cover 109 locked onto structure 118. A lock body 201 of lock 110 has a latch 205 which is locked against a wedgelike protrusion 112 extending from base 108 of structure 118. Also shown in FIG. 3 are a screw 203, a screw 204 and a sleeve 202. These are used to attach cable terminal 101 to other cable terminals as shown in FIG. 4.

Figure 4:
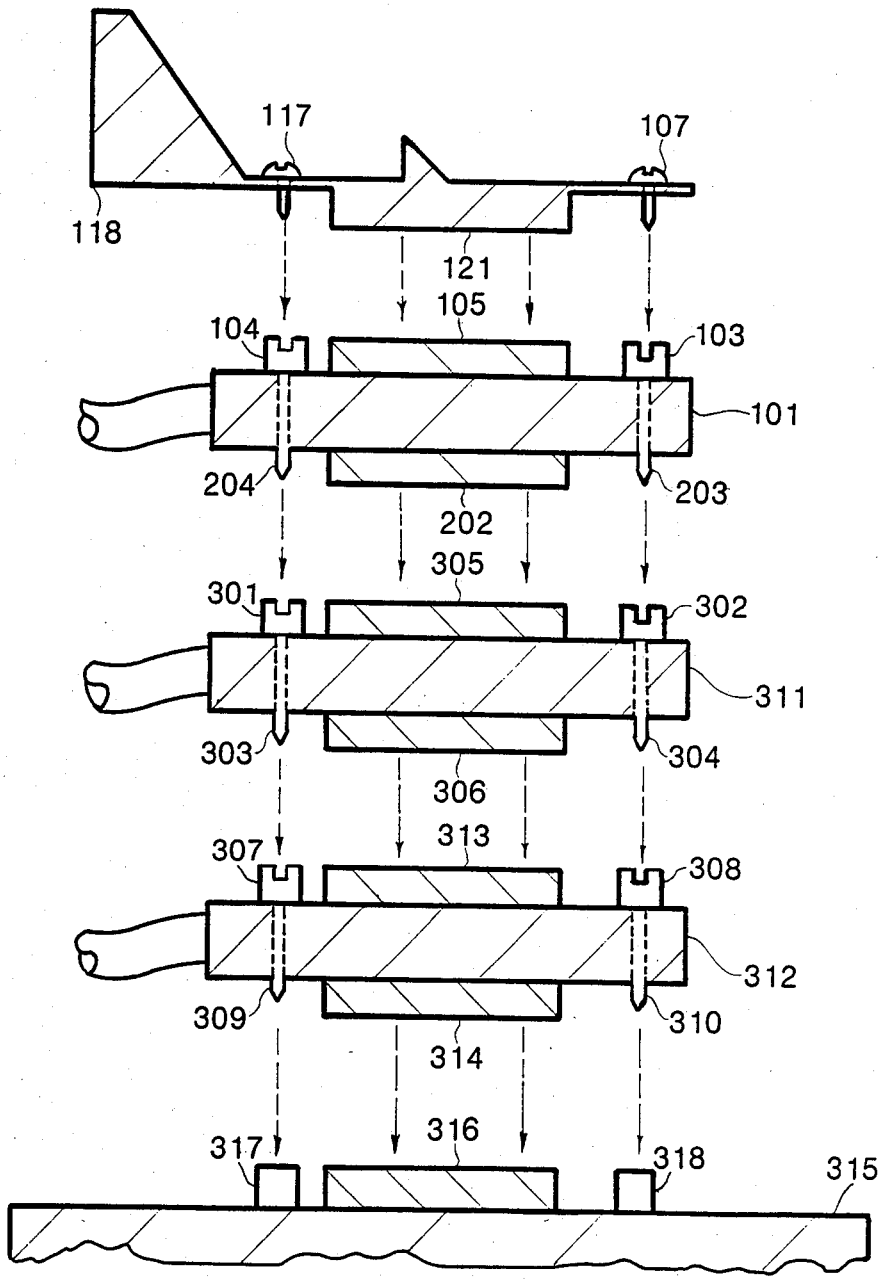
FIG. 4 shows how the first structure of FIG. 1 may be used to secure a series of interconnected cable terminals in accordance with the preferred embodiment of the present invention.

FIG. 4 shows how numerous cable terminals connected to a computer back panel 315 may be capped by structure 118. Computer backpanel 315 has a terminal 316 (containing leads such as leads 106 shown in FIG. 1), a screw receptacle 317 and a screw receptacle 318. A cable terminal 312 having a screw 309 with a screw head 307, a screw 310 with a screw head 308, a sleeve 314 and a sleeve 313 may be attached to computer backpanel 315 by placing sleeve 314 over terminal 316, screwing screw 309 into screw receptacle 317 and screwing screw 310 into receptacle 318. A cable terminal 311 having a screw 303, with a screw head 301, a screw 304 with screw head 302, a sleeve 306 and a sleeve 305 may be attached to cable terminal 312 by placing sleeve 306 over sleeve 313, screwing screw 303 into screw head 307 and screwing screw 304 into screw head 308.

Similarly, cable terminal 101 may be attached to cable terminal 311 by placing sleeve 202 over sleeve 305, screwing screw 204 into screw head 301 and screwing screw 203 into screw head 302. Structure 118 may then be attached to cable terminal 101 as described above. Each successive cable terminal secures all the cable terminals below, that is, once cable terminal 311 is in place cable terminal 312 cannot be removed from computer backpanel 315 without first removing cable terminal 311; once cable terminal 101 is in place cable terminal 311 cannot be removed from cable terminal 312 without first removing cable 101; and once structure 118 is in place cable terminal 101 cannot be removed from cable terminal 311 without first removing structure 118. By preventing access to screws 117 and 107, structure 118 cannot be removed. Therefore, as can be clearly seen, structure 118 may be used to cap any number of cable terminals. Furthermore, it may fit directly over backplane 315 to prevent any cable terminals from being coupled to terminal 316.

FIG. 1 additionally shows a cable 113 having an abutment 114. Cable 113 may be fit into a notch 116 as shown. As can be seen from FIG. 1 and further from FIG. 3, once cover 109 is in place, cable 113 is coupled firmly to structure 118. Then cable 113 can be secured to a stationary object by means of a loop 115, thus hindering an intruder from physically carrying away structure 118 or anything attached thereto.

I claim:

1. An apparatus for securing the protection of a cabling system on a computer, the cabling system having a first terminal to be protected, the first terminal having a first series of leads which is capable of being connected to a series of leads in a second terminal, the apparatus comprising:

a structure which can be mechanically attached to the first terminal so that when the structure is attached to the first terminal the structure covers the first series of leads and prevents connection between the first series of leads and the series of leads in the second terminal; and locking means for preventing removal of the structure from the first terminal.

2. An apparatus as in claim 1 wherein when the structure is attached to the first terminal it prevents additional terminals from being electrically coupled to the first terminal.

3. An apparatus as in claim 1 wherein the structure includes a first screw having a first screw head, and wherein the locking means prevents access to the first screw head.

4. An apparatus as in claim 3 wherein the locking means includes a cover which covers the first screw head and a lock which locks the cover to the structure.

5. An apparatus as in claim 4 wherein the first terminal has a second series of leads which may be connected to a series of leads in a third terminal and wherein when the structure is not connected to the first terminal, the first terminal may be mechanically connected to the second terminal by a second screw having a second screw head.

6. An apparatus as in claim 5 wherein the second screw screws into the first screw head.

7. An apparatus as in claim 6 wherein the third terminal is secured to the first terminal by the first screw.

8. An apparatus as in claim 1 additionally comprising a securing cable which may be attached to the structure and which may be attached to a stationary object.

9. An apparatus as in claim 8 wherein the securing cable includes an abutment at one end of the securing cable, and wherein the cable may be attached to the structure by placing the cable in a notch in the structure and by covering the notch with the cover so that the abutment prevents removal of the cable through the notch.

* * * * *